United States Patent [19]

Lunsford

[11] 4,091,927

[45] May 30, 1978

[54] SEPARABLE PACKAGING AND DISPLAY SYSTEM

[76] Inventor: Thomas Jake Lunsford, 378 W. Madison, El Cajon, Calif. 92020

[21] Appl. No.: 723,505

[22] Filed: Sept. 15, 1976

[51] Int. Cl.[2] ..... B65D 51/24; B65D 73/00

[52] U.S. Cl. ..... 206/459; 206/461; 206/467; 206/493; 220/352

[58] Field of Search ..... 206/45.31, 459, 461–462, 206/464–465, 467, 493, 525–527; 220/352, 354

[56] References Cited

U.S. PATENT DOCUMENTS

| | | | |
|---|---|---|---|
| 3,111,220 | 11/1963 | Bostrom | 206/462 X |
| 3,178,019 | 4/1965 | Fetzek | 206/464 X |
| 3,311,229 | 3/1967 | Troll et al. | 206/461 |

FOREIGN PATENT DOCUMENTS

| | | | |
|---|---|---|---|
| 1,549,480 | 11/1968 | France | 206/462 |
| 2,253,372 | 6/1975 | France | 206/462 |

*Primary Examiner*—Steven E. Lipman
*Attorney, Agent, or Firm*—Brown & Martin

[57] ABSTRACT

A packaging and display carton is constructed of first and second sheets of durable, flexible transparent material of a generally rectangular configuration having a double wall cavity packaging chamber formed in one of the sheets with vertically extending wall and a closure cap with a display window formed in the other sheet wherein the outer walls of the packaging chamber and the inner walls of the display cavity have an interference fit for frictionally engaging and sealing the chamber and retaining the part in the closed position by friction and vacuum. An intermediate labeling and display card or sheet is disposed between the two sheets and includes an opening for receiving the walls of the packaging chamber therethrough. Vacuum locking devices in the form of snug fitting protrusions and sockets for holding the sheets together are disclosed.

8 Claims, 5 Drawing Figures

SEPARABLE PACKAGING AND DISPLAY SYSTEM

BACKGROUND OF THE INVENTION

The present invention relates generally to packaging and pertains particularly to a separable packaging and display carton.

Recent years have seen a rapid expansion in the use of the so-called bubble pack for packaging and displaying articles of merchandise. Such packaging normally employs a transparent sheet vacuum formed on a cardboard backing with the article of merchandise encased therebetween. Such systems have the advantages of providing rapid machine packaging of individual parts permitting ready and convenient display of the packaged article, and reducing pillage.

This packaging system however has numerous disadvantages, especially for the small manufacturer or merchandiser. Such system requires expensive and complicated machinery which a small manufacturer or merchandiser cannot frequently afford. Moreover, manufacturers in remote locations who do not have such machinery may not have access to a packaging firm or jobber. Other disadvantages include the necessity for destroying the package when opening it so it therefore cannot be reused. Also a perforated cardboard required for packaging does not facilitate or contribute to legible instructions and labeling of the package.

SUMMARY AND OBJECTS OF THE INVENTION

The primary object of the present invention is to provide a separable packaging and display system that overcomes the above problems of the prior art.

Another object of the present invention is to provide a readily usable display carton that is simple and inexpensive to manufacture and does not require complicated machinery for the packaging process.

In accordance with the present invention a packaging and displaying carton includes the packaging chamber constructed from a first sheet of flexible durable material the walls of the chamber being defined by continuous uninterrupted upwardly extending walls at least a portion of which are double. A closure member for the package is constructed of a second sheet of durable flexible transparent material shaped to form a closure cavity for receiving at least portions of the wall of the package chamber and including a display window for permitting viewing of the entire package chamber. At least the sheet defining the packaging chamber includes a labeling support surface.

BRIEF DESCRIPTION OF THE DRAWINGS

The above and other objects of the advantages of the present invention will become apparent from the following description when read in conjunction with the drawings wherein.

DETAILED DESCRIPTION OF THE DRAWINGS

Figure 1:
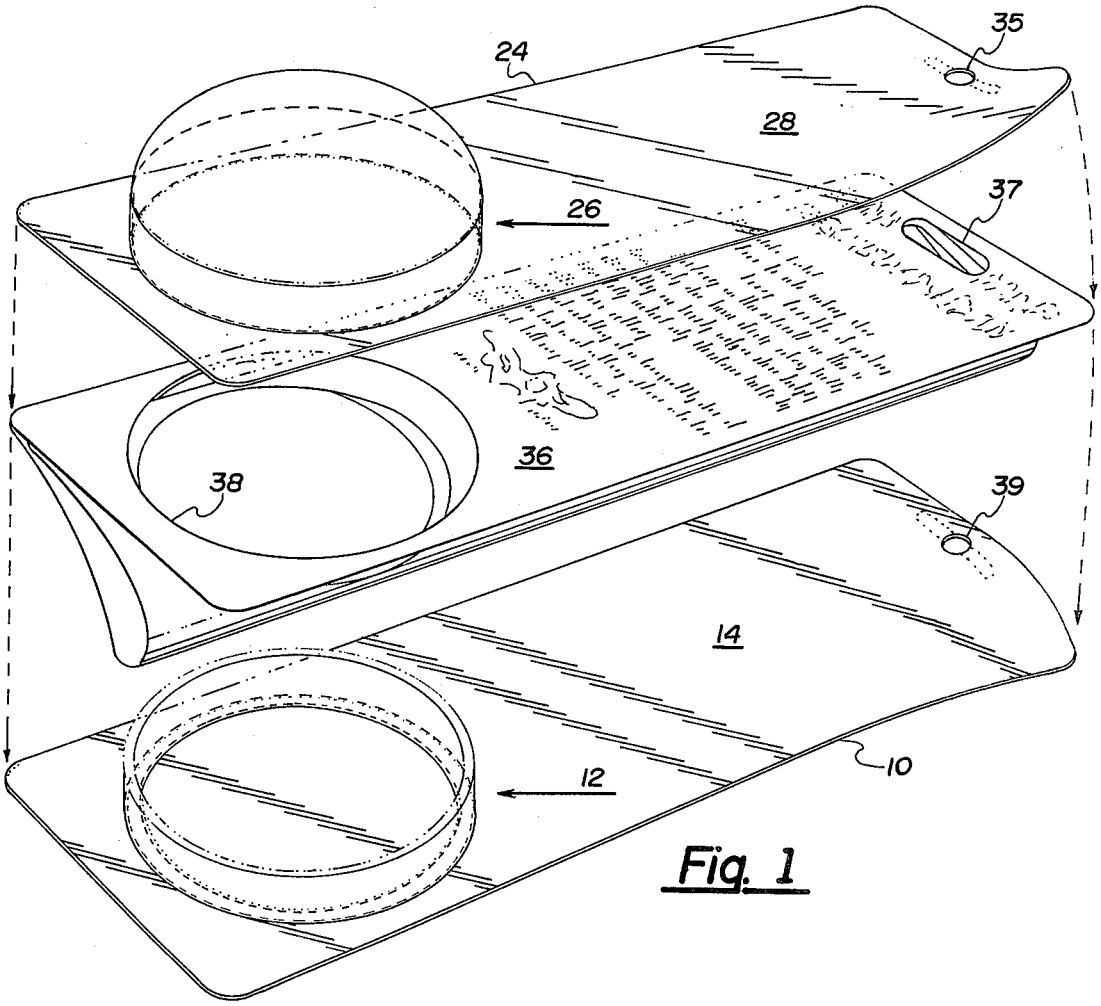
FIG. 1 is an exploded perspective view of a preferred embodiment of the invention.
Figure 2:
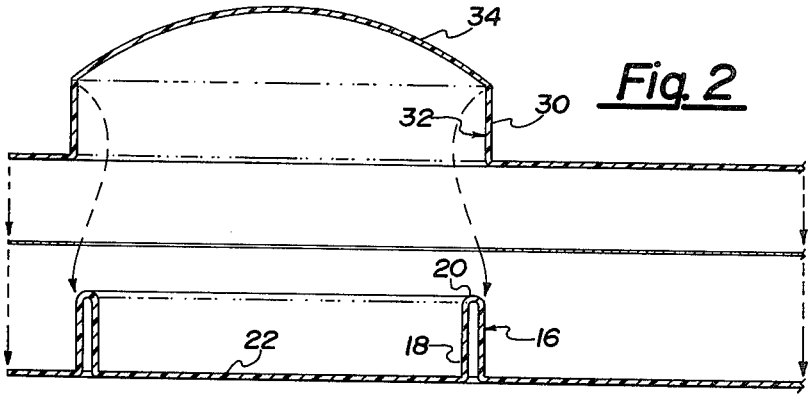
FIG. 2 is an exploded partial view in section of the packaging chamber of FIG. 1.

Turning now to FIGS. 1 and 2 of the drawing there is illustrated a packaging display carton in accordance with the present invention comprising a first substantially rectangular unitary plane sheet of durable plastic material having a first portion on the left side occupying approximately ½ of the sheet defining a packaging chamber generally designated by the numeral 12 and a large flat plane surface adjacent thereto formed by the right side of the sheet defining a labeling support surface 14. The sheet 10 may be of any suitable vacuum formable plastic or may not be transparent as desired.

As best seen in FIG. 2, the chamber 12 is defined by a convoluted portion of the sheet 10 extending upward defining outer wall 16 and an inner wall 18 connected by an inverted U-shaped upper edge 20 and having a bottom 22. The walls are defined by continuous uninterrupted shaping of a sheet 14 with the outer wall 16 extending substantially at right angles upward from the surface of the sheet 10 of sufficient height to define a suitable size packaging chamber. The outer wall 16 may be straight or may if preferred have a slight inward taper such as a minor taper on the order of less than 7 degrees for sealing engagement with the closure member to be described.

A second sheet 24 of durable flexible transparent material of a substantially rectangular configuration is formed at the left end with a closure member generally designated by the numeral 26 and at the right with a labeling display window 28. The labeling display window 28 covers the labeling support surface 14 and permits viewing of labeling, instructions or the like formed on or supported by surface 14.

The closure member 26 as best seen in FIG. 2 is formed by a continuously uninterrupted extension of the sheet 14 into upward cylindrical walls 30 having substantially the same configuration as outer walls 16 and having an inner surface thereof 32 defining an inner diameter which is preferably about equal to but may be slightly less than the outer diameter of the outer surface of wall 16 or thereby defining an interference fit. This interference fit between walls 16 and the surface 32 of walls 30 provides a seal and secures the package together primarily by vacuum in the closed chamber without the necessity of bonding compounds or the like. However it will be appreciated that bonding compounds or other suitable fastening means may be desired in some cases in order to prevent pillage. A dome shaped transparent display window 34 completes the closure member.

It will be appreciated that interference fit for locking purposes may be achieved without the double wall feature as shown in FIG. 2. This double wall feature enhances this locking feature by providing flexibility in the wall 16 not otherwise available. While the entire wall of the emodiment of FIG. 1 is illustrated as being a double wall the entire wall need not be double to achieve the desired end. Furthermore the double wall need not extend the entire depth of the wall itself. Therefore so long as at least a portion of opposite walls contain this double wall feature the desired fit can be achieved. It will also be appreciated that the package provides a vacuum lock of the components together. Thus, when one attempts to separate the two parts, a vacuum is created by the expansion of the air chamber formed by the packaging chamber and closure therein.

The close fit of the walls prevents air from filling the space rapidly.

An intermediate labeling and instruction sheet 36 may also be provided for mounting between the sheets 10 and 24 for providing suitable labeling such as a logo and other information such as instructions or the like. The sheet may be a single sheet such as a cardboard sheet or the like, or may be a multifold sheet as indicated for containing multiple detailed instructions. The sheet is provided with a registered opening 38 extending through the layer thereof for receiving the upward extending walls of the packaging chamber which extend therethrough. The sheet 36 is then sandwiched between the two sheets 10 and 24 when the package is assembled.

Figure 3:
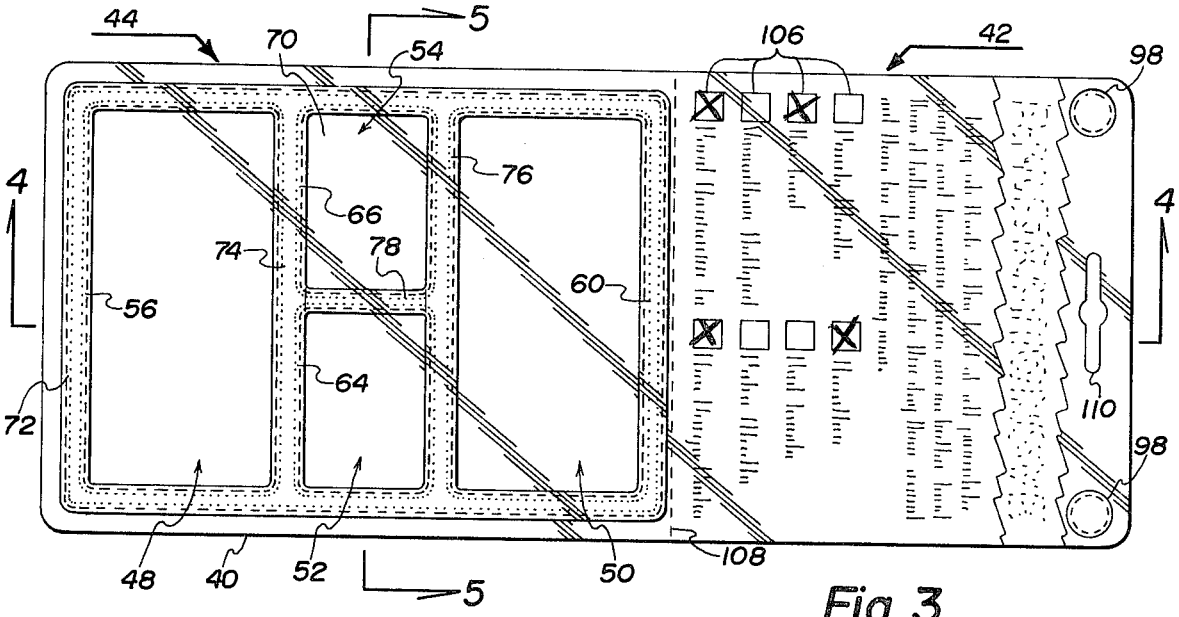
FIG. 3 is a plan view of an alternate embodiment of the invention.
Figure 4:
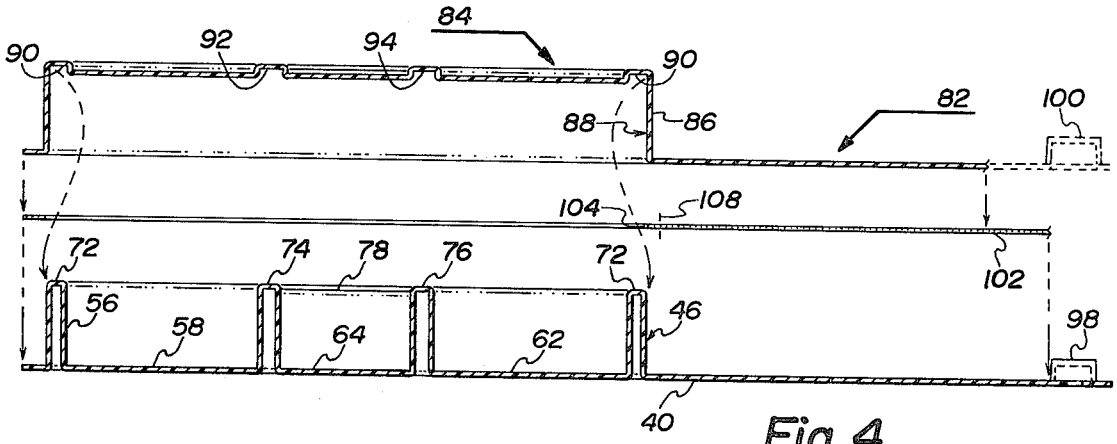
FIG. 4 is a sectional view generally along lines 4—4 of FIG. 3.
Figure 5:
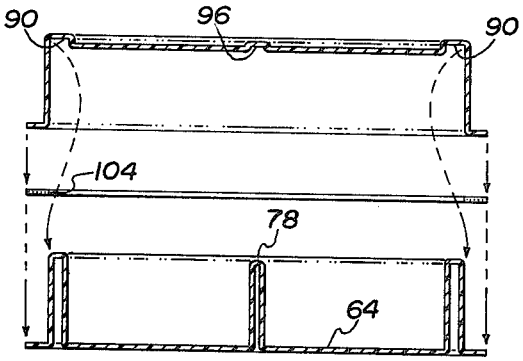
FIG. 5 is a sectional view taken along lines 5—5 of FIG. 3.

Turning now to the embodiment of FIGS. 3 to 5 there is illustrated a multi-chambered or multi-compartmented chamber packaging assembly. In this embodiment a sheet 40 of suitable pliable vacuum forming plastic material is formed as in the previous embodiment to have a labeling support surface 42 and is shaped by a convoluted portion to define by means of a plurality of upwardly extending walls a plurality of packaging chambers indicated generally by the numeral 44. The sheet 40 is of generally rectangular configuration having the labeling support surface formed or defined by one end of the sheet the packaging chamber is formed at the other end. The sheet is formed with a continuous and uninterrupted upwardly extending wall 46 extending upward from the surface of the sheet 40 and extending in a rectangular pattern for defining the outer wall of a complex of chambers or compartments. The package includes a first chamber 48 formed on the end of the sheet and a second chamber 50 of similar size and configuration spaced from the first chamber or compartment and a pair of intermediate compartments 52 and 54 defined between the larger compartments. The compartments 48 include an inner upward extending wall 56 and a bottom defining the packaging chamber. The second chamber 50 comprises a similar inner wall 60 and bottom 62 defining the chamber. The two intermediate chambers are respectively defined by inner walls 64, 66 and by bottoms 68 and 70.

The outer wall 46 of the packaging chambers is connected by a plurality of upper edges 72 through 78 which are generally inverted U-shaped configuration to the respective inner walls.

Although a specific number of chambers or compartments are shown and these are illustrated to have a specific configuration it is to be understood that these may be any number and can have any configuration desired.

An upper or second sheet 80 is formed with a labeling display window 82 at the right edge thereof and a closure vacity and window generally designated by the numeral 84 at the left side thereof for fitting over and enclosing the packaging chambers 44.

As best seen in FIGS. 4 and 5 a closure cavity is formed by upwardly extending walls 86 having an inner surface 88 for the engaging the outer surface of wall 36 of the packaging chamber for frictionally retaining the members in closed position. The closure member is formed with an upper surface separated by means of a plurality of depressions 90 through 96 which complementary receive the upper edges 72 and 78 of the walls defining the separate compartments. These depressions are not for sealing purposes but are for more clearly separating the various compartments and preventing spillage from one compartment to the other. These depressions also effectively separate or divide the upper surface of the closure member into a plurality of individual display windows for the respective article chambers. As in the previous embodiment the slope of the walls 46 and 88 are preferably vertical but may be a minor taper. The walls however are dimensioned and configured for a slight interference fit so that they frictionally engage for retaining the two portions of the package together without the use of adhesives or the like.

The outer corners opposite from the packaging chamber of the sheets 40 and 80 may include further locking means constructed in a fashion somewhat similar to packaging chamber and its closure member. These locking devices comprise a small cylindrical upwardly extending cylindrical button or male member 98 formed on the lower sheet 40 and a complementary cylindrical socket member 100 formed on the corners of the upper sheet 80. These are dimensioned to have an interference or snug fit such that the members 98 extend into and frictionally and sealingly engage the inner walls of the members 100 for locking the corners of the sheets 40 and 80 together by a combination of friction and/or vacuum. These locking members are particularly important when the intermediate labeling and instruction sheet is omitted or is shortened as will be explained later.

An intermediate labeling or instruction sheet 102 may also be included in the assembly and sandwiched between the upper and lower sheets respectively. This intermediate labeling sheet 102 includes an opening 104 for receiving the walls 46 of the packaging chamber. The instruction also preferably includes labeling and/or instruction area falling directly below the labeling display window 82. Any number of the sheets may be included such as an upper labeling sheet and a plurality of lower instruction sheets or the like.

The present packaging system also contemplates a contents labeling device particularly useful with multichambered compartments which extends not only the versatility of the label but the package itself. This includes a portion of the labeling panel as best seen in FIG. 3 which comprises a selected listing of contents 106 each having a selection box for the placement of an "X" or a check mark to indicate the selections included in the multichambered package. Thus, for example, where a manufacturer of jewelry such as necklaces or the like provides numerous different combinations of components for constructing necklaces, he may list all possible components on a series of labels. When the packages are filled then only the compartments included in that package are selectively checked on the label. This permits the use of a single label to be used for a packaging of multiple combinations of elements. This label concept can also be used in conjunction with a single compartment package.

It is also to be appreciated that the labeling card 102 need not extend the full length of the labeled display portion 82. The card may for example, extend only to a point, say 108 sufficiently beyond the walls of the packaging chamber to include minimum desired labeling information.

The present invention essentially provides an off the shelf blister pack that can be used without the use of expensive packaging machinery. It eliminates expensive cardboard backing that requires special printing and treatment. It eliminates much of the transportation and large inventory of articles to be packaged. It allows the use of inexpensive paper and printing for labeling and instruction, and the use of multiple or folded sheets.

While the present invention has been illustrated and described by means of specific embodiments it is to be understood that numerous changes or modifications may be made therein not departing from the spirit and scope of the invention as defined in the appended claims.

Having described my invention, I now claim:

1. A packaging and display carton, said carton comprising:

a first substantially rectangular unitary plane sheet of durable flexible material having a first portion thereof shaped to define a packaging chamber and an adjacent plane labeling support surface, said chamber being defined by continuous uninterrupted walls formed of and rising from said first sheet, at least a portion of said wall being a double wall having inner and outer walls connected by an upper inverted U-shaped rim, a second substantially rectangular unitary sheet of durable flexible transparent material shaped to define a closure cavity and display window, said cavity being defined by walls extending upward from the plane surface of said sheet and having substantially the same shape as the outer walls of said packaging chamber and fitting over the walls of said packaging chamber with a snug fit thereby providing a tight fitting sealing engagement with a vacuum lock therebetween, said second sheet including means defining a labeling display window covering said labeling support surface, and a labeling sheet disposed between said first and second sheets and including an opening therethrough through which the walls of said packaging chamber extend.

2. The packaging and display carton of claim 1 wherein said labeling sheet contains a list of potential articles for displaying in the chamber of said package, and indicia indicating the article displayed.

3. The packaging and display carton of claim 1, including vacuum locking means formed on said first and second sheets, spaced from said packaging chamber and said closure cavity, said locking means comprising a protrusion formed on one of said sheets and a socket formed on the other of said sheets, said protrusion dimensioned for insertion into said socket with tight fitting sealing engagement for thereby forming a vacuum lock between said first and second sheets.

4. The packaging and display carton of claim 1, including vacuum locking means formed on said first and second sheets, said locking means comprising a protrusion formed on one of said sheets and a socket formed on the other of said sheets, said protrusion dimensioned for insertion into said socket with tight fitting sealing engagement for thereby forming a vacuum lock.

5. The packaging and display carton of claim 1 wherein said packaging chamber is substantially cylindrical in configuration; said closure cavity is substantially cylindrical and includes a dome shaped display window.

6. The packaging and display carton of claim 1 wherein said packaging chamber includes a plurality of compartments defined by a plurality of walls extending upward in said compartment.

7. The packaging and display carton of claim 6 wherein said closure means includes depression formed therein for receiving the upper edge of said walls.

8. A packaging and display carton, said carton comprising:

a first substantially rectangular unitary plane sheet of durable flexible material having a first portion thereof shaped to define a packaging chamber and an adjacent plane labeling support surface, said chamber being defined by continuous uninterrupted walls formed of and rising from said first sheet, at least a portion of said wall being a double wall having inner and outer walls connected by an upper inverted U-shaped rim, a second substantially rectangular unitary sheet of durable flexible transparent material shaped to define a closure cavity and display window, said cavity being defined by walls extending upward from the plane surface of said sheet and having substantially the same shape as the outer walls of said packaging chamber and extending over the walls of said packaging chamber with a snug fit thereby providing a tight fitting frictional sealing engagement and thereby defining a vacuum lock therebetween so that said first and second sheets are held together by said vacuum lock, and further vacuum locking means formed on said first and second sheets, said further vacuum locking means comprising a substantially cylindrical protrusion formed on one of said sheets and a substantially cylindrical socket formed on the other of said sheets, said protrusion being inserted into said socket in tight fitting sealing engagement thereby forming a further vacuum lock between said first and second sheets.

* * * * *